United States Patent [19]

Arakawa

[11] Patent Number: 4,895,311

[45] Date of Patent: Jan. 23, 1990

[54] SUPPORTING STRUCTURE FOR THE CRUSHING HEAD OF A CONE CRUSHER

[75] Inventor: Kazuaki Arakawa, Osaka, Japan

[73] Assignee: Kurimoto, Ltd., Osaka, Japan

[21] Appl. No.: 277,395

[22] Filed: Nov. 28, 1988

Related U.S. Application Data

[63] Continuation of Ser. No. 115,566, Oct. 29, 1987, abandoned, which is a continuation of Ser. No. 924,106, Oct. 28, 1986, abandoned, which is a continuation of Ser. No. 721,722, Apr. 10, 1985, abandoned.

[30] Foreign Application Priority Data

Dec. 28, 1984 [JP] Japan ..... 59-279646

[51] Int. Cl.[4] ..... B02C 2/04

[52] U.S. Cl. ..... 241/207; 241/208

[58] Field of Search ..... 241/207-216

[56] References Cited

U.S. PATENT DOCUMENTS

| | | | |
|---|---|---|---|
| 2,799,456 | 7/1957 | Behr | 241/211 |
| 2,833,486 | 5/1958 | MacLeod | 241/215 |
| 3,345,000 | 10/1967 | Decker et al. | 241/209 |
| 3,396,916 | 8/1968 | Kemnitz et al. | 241/207 |
| 3,801,026 | 4/1974 | Decker et al. | 241/211 X |

FOREIGN PATENT DOCUMENTS

| | | | |
|---|---|---|---|
| 1288409 | 1/1969 | Fed. Rep. of Germany | 241/209 |
| 1291181 | 3/1969 | Fed. Rep. of Germany | 241/207 |
| 715133 | 10/1977 | U.S.S.R. | 241/207 |
| 1031679 | 6/1966 | United Kingdom | 241/207 |

*Primary Examiner*—Joseph M. Gorski

*Attorney, Agent, or Firm*—Jones, Tullar & Cooper

[57] ABSTRACT

A novel supporting structure for the crushing head of a cone crusher in which an eccentric rotating in a frame and the crushing head gyrating in the inner periphery of the eccentric are movable up and down by hydraulic pressure, characterized in that a cylindrical socket is inserted in a sleeve of the frame which is slidable up and down while the eccentric and the crushing head are supported by a hydraulic mechanism mounted on the upper end of the sleeve, thereby reducing the overall height of the cone crusher.

9 Claims, 3 Drawing Sheets

SUPPORTING STRUCTURE FOR THE CRUSHING HEAD OF A CONE CRUSHER

This is a continuation of co-pending application Ser. No. 115,566, filed on Oct. 29, 1987, now abandoned, which is a continuation of application Ser. No. 924,106, filed Oct. 28, 1986, now abandoned, which is a continuation of application Ser. No. 721,722, filed Apr. 10, 1985, now abandoned.

BACKGROUND OF THE INVENTION

1. Field of the Invention

The present invention relates to improvements of a supporting structure for a crushing head incorporated in a cone crusher and the like to crush stones or ores.

2. Prior Art

According to the known structure of a cone crusher, a sleeve is either solidly provided at the center of a frame or is integrally fitted with the frame by a method such as shrinkage fitting, bolting or the like, and an eccentric is idly inserted in the sleeve to be rotated while transmitted a rotating force from a drive unit, thereby gyrating a crushing head which is eccentrically inserted inside of the eccentric. Thus, the ores or stones carried therein are crushed by the gyration in the area between a lower liner mounted on the top of the crushing head forming a cone shape and an upper liner mounted on the frame facing the lower liner. The size (grading) of the crushed ores (products) depends upon the discharge opening referred to as the C.S.S. (closed side setting), and therefore when the setting becomes larger as a result of wear of both liners, it is necessary to compensate for the wear of the liners to maintain the specified grading. Furthermore, when the crusher is stopped because of biting such material as tramp irons which are impossible to be crushed, it is necessary to temporalily enlarge the setting for the tramp iron release.

In view of the foregoing necessity, the conventional cone crusher has an adjustment ring with a thread for the wear compensation and springs for the tramp iron release, but has no set-indication system, and therefore the wear compensation must be performed by the following procedure, i.e., loosing the adjustment ring, turning it, checking the state of the discharge opening to be suitable and fixing the adjustment ring.

In order to improve such a conventional method, a cone crusher including a hydraulic mechanism has been proposed so that the eccentric with which the crushing head is internally engaged may be moved up and down, i.e., reciprocated while a torque is applied, as is disclosed in Japanese Patent Publication (examined) No. 57-58216 (FIG. 4) or in Japanese Utility Model Publication (unexamined) No. 58-178345 (FIG. 3).

In any of the foregoing known cone crushers, however, a hydraulic fluid chamber is located at the center of the bottom part of the crusher, and hydraulic pressure is introduced into this chamber (or cylinder) from outside of the crusher so that the main shaft of the eccentric or the crushing head may be directly (or through a piston inserted therein) moved up and down (lifted or lowered), thereby the discharge opening between the two liners is enlarged and narrowed.

In other words, in the case of the known arts, since the bottom part of the head center is supported by the top end of the main shaft or by the top end of the eccentric 2' (FIG. 4) or the bottom part of the main shaft is supported by the frame (FIG. 3), in order to adjust the discharge opening, the hydraulic fluid chamber is located at the lower bottom of the crusher.

Accordingly, not only the overall height becomes larger by such an arrangement of the hydraulic fluid chamber at the bottom part of the crusher, but the weight of the crusher is increased. Moreover, incidental works such as installment of means for conveying materials to be crushed also become bulky. Furthermore, since it is required to make a space for carrying out maintenance of the hydraulic fluid chamber located at the bottom portion, a specified consideration is indispensable for the layout thereof. Thus, there exist common problems to be overcome in the known cone crushers.

SUMMARY OF THE INVENTION

It is therefore an object of the present invention to provide a novel supporting structure of the crushing head for use in a hydraulic cone crusher in which even during the operation thereof the eccentric including the crushing head is freely movable up and down, wherein the overall height of the crusher is reduced by incorporating the hydraulic fluid chamber into the upper part thereof.

In order to accomplish the foregoing object, a supporting structure of the crushing head for a cone crusher in accordance with the present invention is characterized in that a cylindrical socket inserted in a sleeve of the frame is slidable up and down while the eccentric and the crushing head is supported by the hydraulic mechanism mounted on the upper end of the sleeve.

More specifically, the supporting structure according to the present invention is characterized in that a cylindrical socket shaft 6 movable up and down is mounted in the inner periphery of a sleeve 4 which is vertically provided in a frame 1. An eccentric 2 is rotatably provided in the inner periphery of the socket shaft 6 and is engaged with a drive unit to be slidable up and down. A crushing head 3 is rotatably and eccentrically inserted in the inner periphery of the eccentric, and the socket shaft 6 is supported by the hydraulic fluid chamber 5 through a sliding member movable up and down.

By adopting the foregoing supporting structure of a crushing head, wherein the hydraulic fluid chamber is not incorporated into the lower bottom part of the crusher but into the upper part thereof, being quite different from the prior art, it is possible to restrain the overall height of the crusher and to reduce the total weight thereof. It is further possible that incidental equipment for feeding the materials to be crushed such as a conveyor line, bucket elevator, etc. are also small-sized or compact.

Other objects, features and advantages of the present invention will become apparent in the course of the following description with the accompanying drawings.

BRIEF DESCRIPTION OF THE DRAWINGS

In the accompanying drawings forming a part of the present application, and in which like parts are designated reference numerals throughout the same.

DESCRIPTION OF THE PREFERRED EMBODIMENTS

Referring now to the accompanying drawings some of the preferred embodiments are described in detail hereunder.

Figure 1:
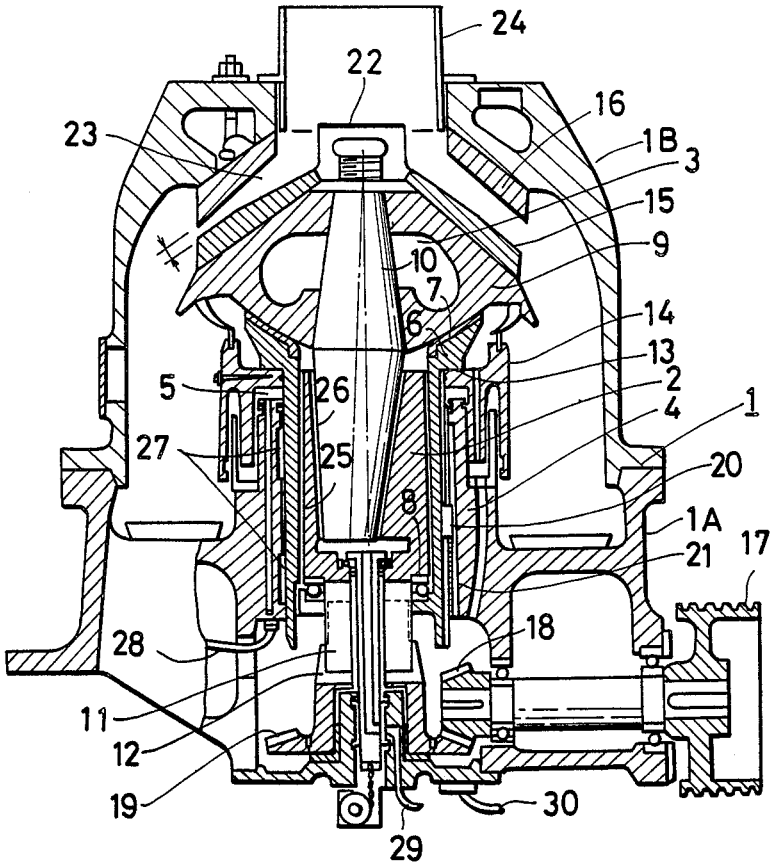
FIG. 1 is a front sectional view showing the first embodiment of the present invention.

In FIG. 1 showing a preferred embodiment of the present invention, a frame 1 comprises a lower frame 1A and an upper frame 1B combined with each other, and the side of the bottom of the lower frame 1A is connected with a drive unit. In other words, the power from the drive source located outside the crusher is transmitted to a pulley 17 to rotate a pinion 18 provided at the end of the same shaft. Rotation of the pinion 18 is converted to the rotation of a gear 19 engaged with the pinion 18. The upper end of the body portion of the gear 19 is formed to be a lower coupling of large depth to be engaged with an upper coupling 11. Since the couplings 11, 12 are engaged with each other with sufficient depth, when the upper coupling 11 is moved up and down by a required distance a sufficient length of engagement as well as strength is assured so as to prevent disengagement.

The upper coupling 11 is located at the lower part of the eccentric 2, and the main shaft 10 of the crushing head is rotatably inserted in the inner periphery of the eccentric 2. The eccentric 2 is supported by the step bearing 8 mounted on the lower and inner periphery of the socket shaft 6 together with the gyrating member assembled on the eccentric 2.

A key 20 is projectingly provided on the side of the socket shaft 6, and this key 20 is inserted in a key groove 21 provided on the inner periphery of the sleeve 4 in the axial direction to prevent the socket shaft from rotation but making it movable up and down. A concave is formed on the upper end of the socket shaft 6 onto which a spherical bearing is adapted as the socket shaft liner 7.

A flange 13 is projectingly provided on the upper and outer periphery of the socket shaft 6 with a difference in level, and an outer cylinder 14 is held to be movable up and down between the flange 13 and the top of the sleeve 4 by the ring-shaped hydraulic fluid chamber 5 and the hydraulic pressure.

Numeral 22 is a head nut to be mounted on the head of the main shaft 10, and numeral 23 is a crushing chamber which is formed by a spacing between the lower liner 15 and the upper liner 16. Numeral 24 is a feed hopper of the object to be crushed such as ores, stones or the like. Numerals 25 and 26 are an outer bushing and an inner bushing mounted respectively on the outer periphery and the inner periphery of the eccentric 2, and numeral 27 is a cylindrical bushing mounted on the outer periphery of the socket shaft 6. Numeral 28 is a hydraulic line pipe, numeral 29 is a lube feeding pipe, and numeral 30 is a return lube pipe.

Since the cone crusher of this embodiment is constructed as above-described, when the drive unit is started, the eccentric 2 connected therewith starts rotating. When the eccentric 2 rotates, the crushing head 3 inserted eccentrically in the inner periphery of the eccentric 2 starts a gyrating movement. In this connection, although the torque is not transmitted to the crushing head 3, since the crushing head 3 is rotatably inserted in the eccentric 2, the crushing head 3 is turned slowly by friction.

The socket shaft 6 is provided on the outer periphery of the eccentric and the sleeve 4 is fixed onto the frame 1 on the further outer periphery of the socket shaft 6, but the torque of the eccentric 2 is not transmitted thereto structurally.

With respect to the movement up and down (or moving up and lowering) in accordance with the foregoing structure, since the hydraulic fluid chamber is mounted on the upper end face of the sleeve 4 fixed to the frame 1, when some hydraulic pressure is applied to the hydraulic fluid chamber 5 from outside or is reduced, the socket shaft 6 is moved up or lowered through the sliding member. Since the socket shaft 6 is slidable up and down while supporting the eccentric 2 and the crushing head 3, when applying the hydraulic pressure from outside, a moving-up force is transmitted sequentially in order to the outer cylinder 14, the socket shaft 6, the eccentric 2 (while rotating) and the crushing head 3 (while gyrating), and eventually the crushing head 3 comes to enlarge or narrow the discharge opening between it and the frame 1 while making gyrating movement.

Figure 2:
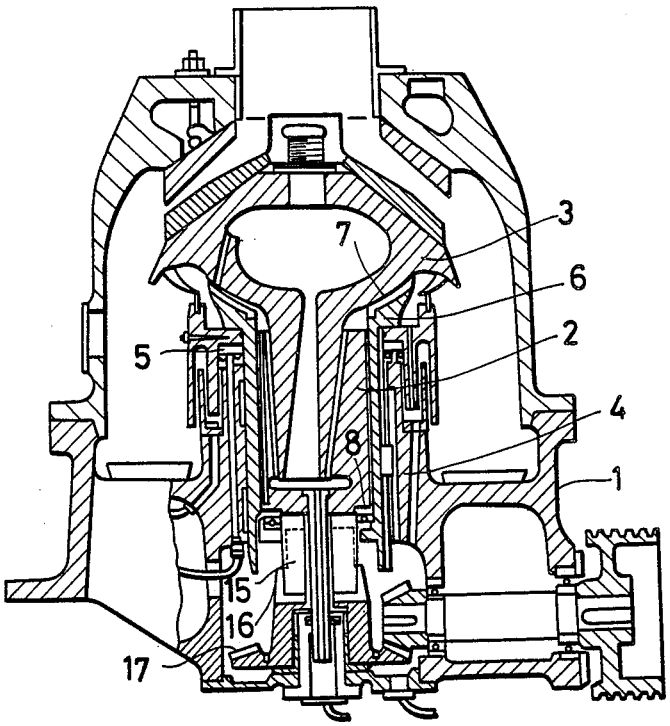
FIG. 2 is a front sectional view showing the second embodiment of the present invention.
Figure 3:
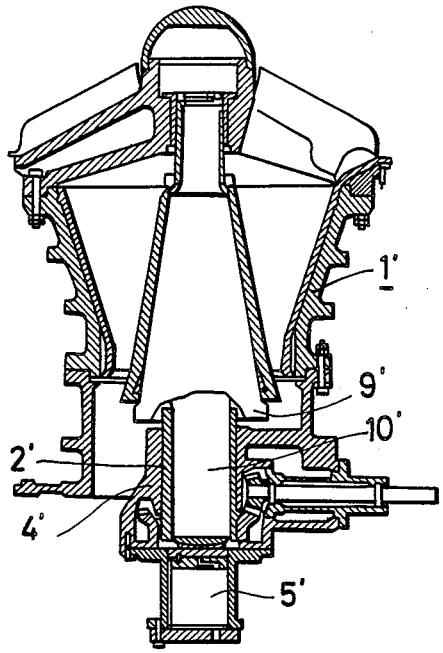
FIG. 3 PRIOR ART
FIGS. 3 and 4 are front sectional views respectively showing the different prior arts.
Figure 4:
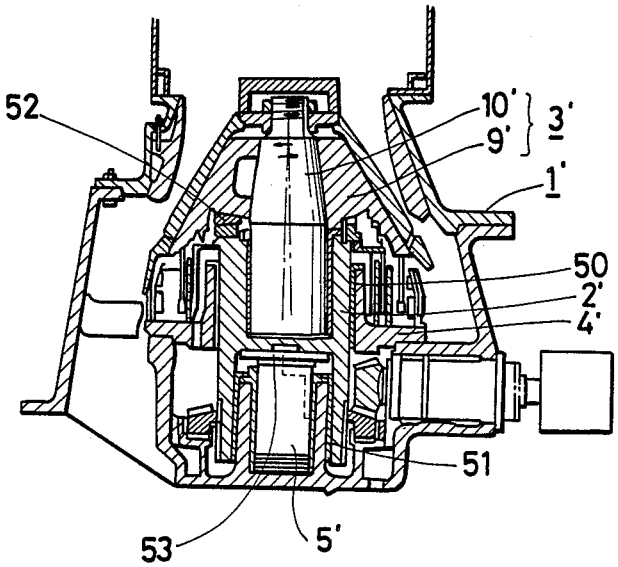
FIG. 4 PRIOR ART

Referring to FIG. 2 showing the second embodiment of the present invention, the crushing head 3 is formed to be solid, hollow and mushroon-shaped without distinction between the main body and the main shaft thereof.

As the present invention may be embodied in several forms without departing from the spirit of the essential characteristics thereof, the foregoing embodiments are therefore illustrative and not restrictive, since the scope of the invention is defined by the appended claims rather than by the preceeding description, and all changes that fall within meets and bounds of the claims, or equivalence of such meets and bounds are therefore intended to be embraced by the claims.

What is claimed is:

1. A cone crusher, comprising:

a frame defining a sleeve having an upper end;

an eccentric situated for rotation within the frame;

a cylindrical socket shaft situated for reciprocal movement within the sleeve, said eccentric extending into and being supported by the socket shaft;

a crushing head partly defining a crushing chamber and having a portion extending into the eccentric for gyration of the crushing head relative thereto;

a hydraulic fluid chamber situated at the upper end of the sleeve below the crushing chamber, said hydraulic fluid chamber providing hydraulic pressure for reciprocating said eccentric and the crushing head; and an outer cylinder which together with the upper end of the sleeve partly defines the hydraulic fluid chamber, said outer cylinder supporting said cylindrical socket shaft and being reciprocally moved by the hydraulic pressure in the hydraulic fluid chamber.

2. The cone crusher as defined in claim 1, further comprising:

a drive unit engageable with the eccentric.

3. The cone crusher as defined in claim 2, wherein the hydraulic fluid chamber is ring shaped.

4. The cone crusher structure as defined in claim 3, wherein the socket shaft includes a flange adjacent to the crushing head and the outer cylinder includes a flange which engages the socket shaft flange, said outer cylinder flange being situated for reciprocal movement between the socket shaft flange and the upper end of the sleeve.

5. The cone crusher as defined in claim 2, wherein the eccentric includes a toothed coupling serving as an upper coupling and the drive means includes a toothed coupling serving as a lower coupling engageable with the upper coupling, the extent of said engagement being such that the drive from said drive unit to the eccentric is maintained throughout the reciprocal movement of the socket shaft.

6. The cone crusher as defined in claim 2, wherein the crushing head comprises a cone-shaped body and a main shaft inserted in said body.

7. The cone crusher as defined in claim 2, wherein the crushing head comprises a mushroom shaped solid with a hollow inner portion.

8. The cone crusher as defined in claim 1, wherein the crushing head comprises a cone-shaped body and a main shaft inserted in said body.

9. The cone crusher as defined in claim 1, wherein the crushing head comprises a mushroom shaped solid with a hollow inner portion.

* * * * *